US011161709B2

(12) United States Patent
Gerdsmann et al.

(10) Patent No.: US 11,161,709 B2
(45) Date of Patent: Nov. 2, 2021

(54) ADHESIVE TAPE APPLICATOR WITH PIVOTABLE DEFLECTOR EDGE UNIT

(71) Applicant: tesa SE, Norderstedt (DE)

(72) Inventors: Thomas Gerdsmann, Hamburg (DE); Tristan Wienzek, Barsbüttel (DE)

(73) Assignee: tesa SE, Nordestedt (DE)

( * ) Notice: Subject to any disclaimer, the term of this patent is extended or adjusted under 35 U.S.C. 154(b) by 184 days.

(21) Appl. No.: 16/430,276

(22) Filed: Jun. 3, 2019

(65) Prior Publication Data

US 2019/0367311 A1 Dec. 5, 2019

(30) Foreign Application Priority Data

Jun. 5, 2018 (DE) ..... 10 2018 208 845.4

(51) Int. Cl.

| | |
|---|---|
| ***B65H 16/00*** | (2006.01) |
| ***B65H 35/00*** | (2006.01) |
| ***B65H 35/07*** | (2006.01) |
| ***B65H 23/26*** | (2006.01) |

(52) U.S. Cl.

CPC ..... *B65H 23/26* (2013.01); *B65H 16/005* (2013.01); *B65H 35/0026* (2013.01); *B65H 35/0033* (2013.01); *Y10T 156/1795* (2015.01)

(58) Field of Classification Search

CPC ..... B65H 35/0026; B65H 35/0033; B65H 16/005; Y10T 156/1795

See application file for complete search history.

(56) References Cited

U.S. PATENT DOCUMENTS

| | | | | |
|---|---|---|---|---|
| 5,641,377 A * | 6/1997 | Chung | B65H 35/0033 | 156/523 |
| 5,992,490 A * | 11/1999 | Kakita | B65H 35/0026 | 156/443 |
| 6,098,685 A * | 8/2000 | Maeda | B65H 37/005 | 156/391 |
| 6,508,287 B1 * | 1/2003 | Shinozaki | B29C 63/024 | 156/391 |
| 6,698,489 B1 * | 3/2004 | Shinozaki | B65H 37/005 | 156/574 |
| 6,796,351 B1 * | 9/2004 | Maeda | B65H 37/005 | 156/391 |
| 8,187,409 B2 * | 5/2012 | Anderson | B65H 37/005 | 156/297 |

(Continued)

FOREIGN PATENT DOCUMENTS

| | | |
|---|---|---|
| DE | 694 28 900 T2 | 4/2002 |
| DE | 697 26 767 T2 | 11/2004 |

(Continued)

OTHER PUBLICATIONS

The First Office Action dated Jul. 7, 2020 in related Chinese Application No. 201910484875.6.

(Continued)

*Primary Examiner* — Mark A Osele

(74) *Attorney, Agent, or Firm* — McGuireWoods LLP

(57) ABSTRACT

An adhesive tape applicator with a holder for a roll of adhesive tape and at least one handle and an applicator head arranged so that it is in a fixed position relative to the handle, wherein a deflector edge unit is arranged in particular so that it can move relative to the applicator head.

8 Claims, 5 Drawing Sheets

(56) References Cited

U.S. PATENT DOCUMENTS

| | | | | |
|---|---|---|---|---|
| 8,955,572 | B2 * | 2/2015 | Huang | B65H 35/0086 156/527 |
| 9,926,165 | B2 * | 3/2018 | Chen | B65H 35/0073 |
| 2003/0183060 | A1 * | 10/2003 | Yu Chen | B65H 35/0033 83/743 |
| 2007/0267148 | A1 * | 11/2007 | Steele | B65H 35/0026 156/577 |
| 2010/0101734 | A1 * | 4/2010 | Chang | B26F 3/02 156/527 |
| 2019/0112144 | A1 * | 4/2019 | Naber | B65H 35/0033 |
| 2020/0353739 | A1 * | 11/2020 | Rodriguez | B32B 38/10 |
| 2020/0399087 | A1 * | 12/2020 | Nash | B65H 35/0026 |

FOREIGN PATENT DOCUMENTS

| | | | |
|---|---|---|---|
| DE | 202016008252 | U1 | 8/2017 |
| DE | 10 2016 226 058 | A1 | 6/2018 |
| JP | 2008184229 | A | 8/2008 |
| JP | 2007253825 | A | 7/2011 |

OTHER PUBLICATIONS

Korean Office Action dated Jun. 25, 2020 in related Korean Patent Application No. 10-2019-0064745.

German Office Action dated Feb. 15, 2019, issued in German Application No. 10 2018 208 845.4.

* cited by examiner

ADHESIVE TAPE APPLICATOR WITH PIVOTABLE DEFLECTOR EDGE UNIT

TECHNICAL FIELD

The invention relates to an adhesive tape applicator with a holder for a roll of adhesive tape and at least one handle and an applicator head arranged so that it is in a fixed position relative to the handle.

BACKGROUND

Adhesive tape applicators are of course in principle known from the prior art.

A handheld adhesive tape dispenser with a compact structure is known from DE 20 2007 011 400 U1. The handheld adhesive tape dispenser disclosed therein has a hinged housing with two housing half-shells which store a roll of adhesive tape in the hinged-together state. A spindle onto which the roll of adhesive tape can be pushed is formed by two spindle pins which can be pushed into each other and are arranged on the inside on each of the two housing half-shells. A problem with the handheld adhesive tape dispenser is that it is only possible with difficulty to apply a piece of masking tape along an edge, in guided fashion, at a specific distance.

A handheld device for dispensing an adhesive tape is disclosed in DE 10 2005 034 007 A1. The adhesive tape consists of a substrate which is equipped with an adhesive layer on one side and the adhesive substance of which is covered by a strip of separating material. The handheld adhesive tape dispenser allows the strip of separating material to be freed automatically from the adhesive layer of the substrate during the application procedure. It is also a disadvantage of this handheld adhesive tape dispenser that, on the one hand, it is only possible with difficulty to apply the adhesive tape along an edge in guided fashion and, on the other hand, a handle directed in the direction of application prevents the application in the direction of application.

A handheld adhesive tape dispenser for applying an adhesive tape in a direction of application to a soiled surface is known from DE 20 2012 004 079 U1. A cleaning device for cleaning surfaces is here provided in front of a pressure roller in the direction of application.

A problem with the known applicators is that they are not suited for sticking an adhesive tape to the inside of a gap. Such gaps occur, for example, in vehicle construction between a roof side rail and a door.

During vehicle manufacture, the doors have not yet been provided with an inner lining or seals such that a gap a few millimetres wide is formed between the door and a roof. A gap is thus formed along the front door between the A and B pillars and along the rear door between the B and C pillars, in each case along the whole roof side rail.

The doors are mounted and closed during vehicle manufacture. When two layers of paintwork are applied to a vehicle, something which has become more and more common, the whole bodywork is first painted in a first colour. A removable adhesive strip must then be applied to the first colour in order to ensure a defined paint edge between the first and a second application of paint. The strip of adhesive tape is stuck to the inside of the roof side rail along the door gap. The roof side rail disadvantageously has, between the inner side and the outer side, an angle which changes over the longitudinal extent and is approximately 90° but can vary between 45° and 145°.

Known adhesive tape applicators do not permit stable manual guidance along the gap.

SUMMARY OF THE INVENTION

The object of the invention is therefore to make available an adhesive tape applicator mentioned at the beginning which makes it possible to stick an adhesive tape to the inside of a gap even when the outer contact surface of the gap changes over the longitudinal extent.

The object is achieved by an adhesive tape dispenser mentioned at the beginning, having the features of claim 1.

The invention exploits the idea of making available an adhesive tape applicator with an applicator head on which a deflector edge unit is preferably arranged so that it can move relative to the applicator head. The deflector edge unit is designed so that it is short in the longitudinal direction, i.e. 5 to 10 cm or even shorter, and it has a height of less than 2 cm, preferably less than 1 cm, preferably less than 0.5 cm, such that the deflector edge unit can be inserted into the gap.

The deflector edge unit which can move relative to the applicator head is preferably tensioned by a spring. An angle of a neutral position is here preferably less than a smallest angle of the roof side rail between the contact side and the application side such that an application side of the deflector edge unit bears against an application side of the roof side rail with constant pressure.

The application side of the roof side rail is the side of the gap to which the adhesive tape is applied.

In a preferred embodiment of the invention, the deflector edge unit is arranged so that it can be rotated about a longitudinal axis relative to the applicator head, and the deflector edge unit is coupled to the applicator head by means of a spring which presses the deflector edge unit into a neutral position relative to the applicator head. The neutral position is an angular position which is smaller than the smallest outer angle between the lateral contact side and the application side of the profile to which the adhesive is to be applied, in particular of the roof side rail of a motor vehicle.

The spring can preferably be a leg spring which is threaded about a longitudinal axis and bears with one leg on the deflector edge unit and with the other leg against the applicator head and holds it in the neutral position.

The applicator head preferably has at least one transverse groove, extending transversely to the direction of application, for the adhesive tape and a longitudinal groove arranged in the direction of application on an application side of the deflector edge unit. The purpose of the transverse groove is to guide the adhesive tape from a handle side of the applicator head, under the applicator, along the transverse groove to the application side of the applicator head. The transverse groove is here guided preferably completely but at least partially along the deflector edge unit. The transverse groove ends in a deflector edge, extending obliquely, about which the adhesive tape is guided and is then guided further by the longitudinal groove along the application side. The deflector edge can also take the form of a groove.

The adhesive side of the adhesive tape is uncovered on the application side so that the adhesive side can be stuck directly to the inner side of the roof side rail.

A pressure aid, preferably a pressure adhesive tape, is preferably inserted along the longitudinal groove. The pressure adhesive tape can be a foam adhesive tape which is stuck into the longitudinal groove along a section of its longitudinal extent, possibly also along the whole longitudinal extent. A free side of the pressure aid, opposite the groove, can be provided with an additional friction-reduction layer such that the adhesive tape extends along the layer with as little friction as possible and is pressed by the pressure adhesive tape against the inner side of the roof side rail. It is also conceivable that a so-called gliding tape is stuck over the whole groove including the pressure aid.

A holder preferably has a spindle, oriented in the direction of application, onto which the roll of adhesive tape can be pushed, wherein the adhesive tape can be supplied to the applicator head around at least one, preferably two deflector rollers. Any greater number of deflector rollers is also conceivable.

The holder is preferably arranged such that the roll of adhesive tape is arranged with its winding level preferably transversely, particularly preferably at right angles, to the direction of application, such that the adhesive tape is unwound from the roll of adhesive tape with its adhesive side at right angles to the direction of application. By virtue of being deflected around the deflector edge which is preferably arranged at an angle of 45°, after it has passed the at least one deflector roller, the adhesive tape is deflected and oriented in the direction of application.

The applicator head with the deflector edge unit is particularly preferably arranged replaceably on a base unit. The base unit comprises the handle and the holder for the roll of adhesive tape. The applicator head is a part subject to wear because the adhesive tape is guided around the deflector edge and the latter is worn down over the course of time. Furthermore, both the pressure adhesive tape is worn down and the strength of the magnets is reduced.

The deflector edge unit favourably has a first and a second deflector edge, wherein the second deflector edge is arranged as a mirror image of the first one. The deflector edge unit is arranged on the applicator head and the applicator head can be fastened in different positions on a block of the base unit. The different positions correspond to the two different directions of application in which the tape can be stuck into the gap by a user by a manual pivoting motion. The user can insert the adhesive tape into the gap with a right-to-left motion or with a different left-to-right motion. One of the two deflector edges is used depending on the direction of application. The whole adhesive tape applicator is modified accordingly depending on the direction of application.

The applicator head furthermore preferably has a lateral contact side on which at least one magnet is arranged. At least one magnet is likewise arranged on the application side. The magnets maintain the contact side and the application side each in constant contact with a metal profile during the application. In this alternative embodiment, the deflector edge unit can be arranged so that it can move relative to the applicator head but it is preferred if the deflector edge unit is rigid.

BRIEF DESCRIPTION OF THE DRAWINGS

The invention is described with the aid of an exemplary embodiment in six drawings, in which.

DETAILED DESCRIPTION

Figure 1:
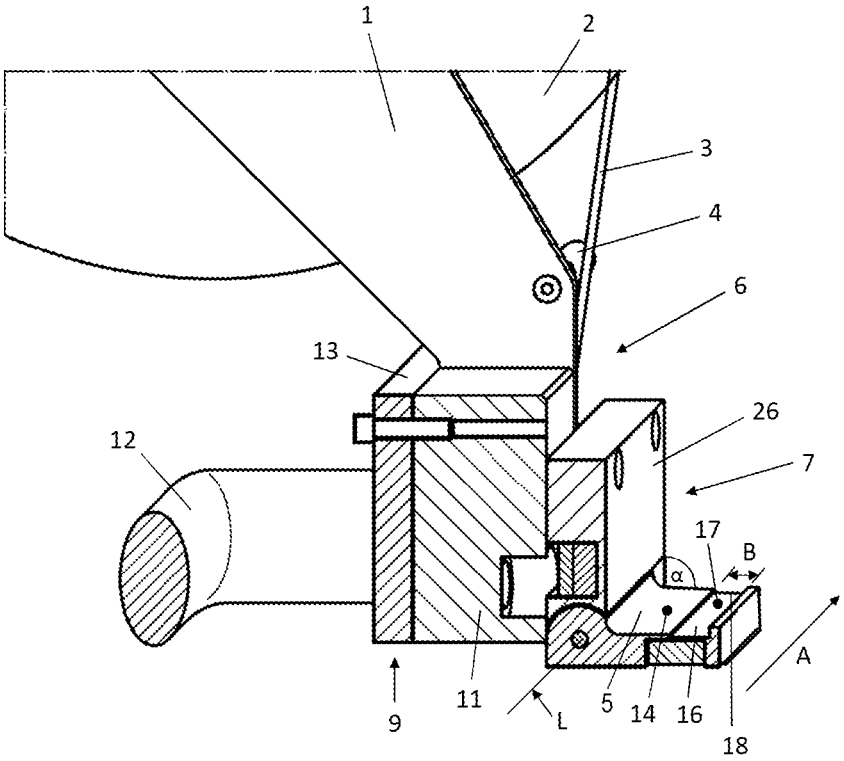
FIG. 1 shows a perspective view in section of an adhesive tape applicator according to the invention.

The view in section shown in FIG. 1 shows the adhesive tape applicator according to the invention with a holder 1 for a roll 2 of adhesive tape. The roll 2 of adhesive tape can be changed or replaced after use. A free end of an adhesive tape 3 freed from the roll 2 of adhesive tape is deflected via a first and a second (not shown) deflector roller 4, 6 and supplied to an applicator head 7 with a deflector edge unit 5. The roll 2 of adhesive tape has an adhesive side applied to the adhesive tape on the inside of the turns.

The adhesive tape applicator comprises a base unit 9 and the applicator head 7 arranged on the base unit 9 so that it can be replaced. The base unit 9 comprises the holder 1 for the roll 2 of adhesive tape, with a spindle arranged at its free end, onto which the roll 2 of adhesive tape can be pushed, and a block 11 on which the holder 1 is fastened so that it is fixed in position. At least one handle 12, opposite the applicator head 7, is arranged on the block 11, fixed in position with respect to the block 11. The handle 12 is fastened on a plate 13 which is in turn fastened on the block 11. The two deflector rollers 4, 6 are arranged rotatably on the sides of the holder 1, opposite the block 11.

The applicator head 7 is screwed into place removably on the block 11 on the side opposite the handle 12. The deflector edge unit 58 is provided on the applicator head 7, on the side remote from the roll 2 of adhesive tape. The deflector edge unit 5 is designed so that it can pivot relative to the applicator head 7 by an angle $\alpha$. The deflector edge unit 5 is arranged so that it can pivot about a longitudinal axis L. The longitudinal axis L extends in a direction of application A of the adhesive tape 3. The roll 2 of adhesive tape likewise has a longitudinal axis which is likewise arranged in the direction of application A.

The deflector edge unit 5 has an application side 14 which is arranged in FIG. 1 on the top of the deflector edge unit 5. A longitudinal groove 16 is provided along the application side 14. A pressure adhesive tape 17, not shown in FIG. 1, is stuck inside the longitudinal groove 16. The pressure adhesive tape 17 is a foam adhesive tape which has a width which corresponds to a width B of the longitudinal groove 16. The pressure adhesive tape 17 extends along a section of the longitudinal extent of the longitudinal groove 16 and is stuck inside the longitudinal groove 16. A friction-reduction layer can be applied to a free outer side, averted from the longitudinal groove 16, of the pressure adhesive tape 17.

Figure 2:
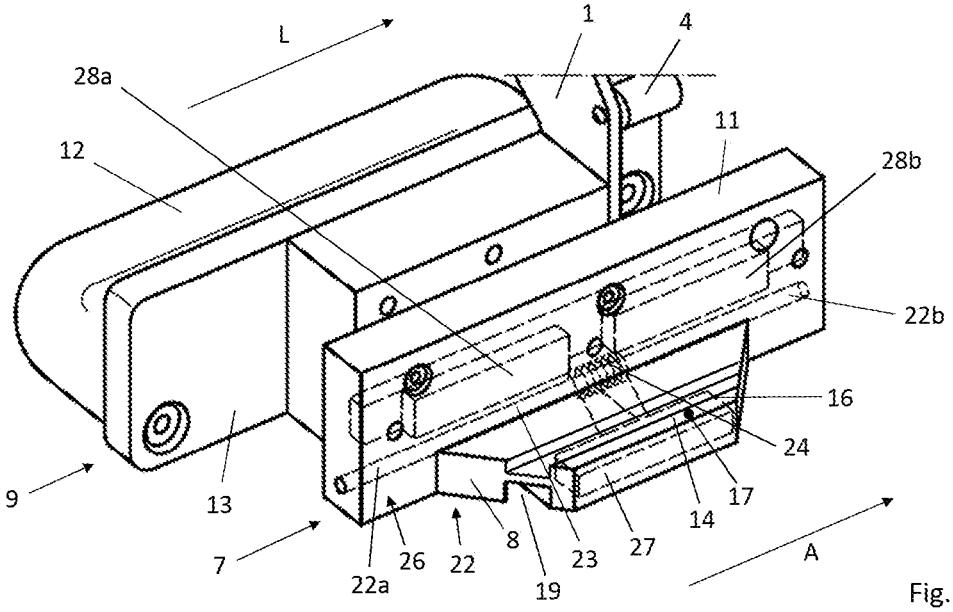
FIG. 2 shows a perspective view, part of which is transparent, of the adhesive tape applicator in FIG. 1.

The adhesive tape 3 is guided about a deflector edge 18 which is oblique with respect to the direction of application A. FIG. 2 shows, with the deflector edge unit 8 transparent, the detailed structure of the deflector edge unit 8. The adhesive tape 3, no longer shown in FIG. 2, is guided about the first deflector roller 4 and the second deflector roller 6 according to FIG. 1, which is situated downstream in the direction in which the tape is pulled out. The adhesive tape 3 is guided below the deflector edge unit 8 in a transverse groove 19, which is let into the deflector edge unit 8, from a handle side to the deflector edge 18 of the applicator head 7. The transverse groove 19 extends at right angles to the direction of application A and at right angles to the axis of rotation of the deflector edge unit 8.

On the application side 14, the transverse groove 19 opens into the oblique deflector edge 18. An adhesive tape is guided around the deflector edge 18 and onwards in the longitudinal groove 16 on the application side 14 of the applicator head 7 or of the deflector edge unit 8. The longitudinal groove 16 extends in the direction of application A.

Both the applicator head 7 and the deflector edge unit 8 have a mirror-symmetrical design and have corresponding fastening means on the block 11 for this purpose. The adhesive tape applicator shown in FIG. 2 is designed for the application of the adhesive tape 3 by means of a right-to-left motion of the hand in the direction of application A. If the direction of application A were to be from left to right, the holder 1 and the applicator head 7 would have to be arranged mirror-symmetrically on the block 11.

Figure 3:
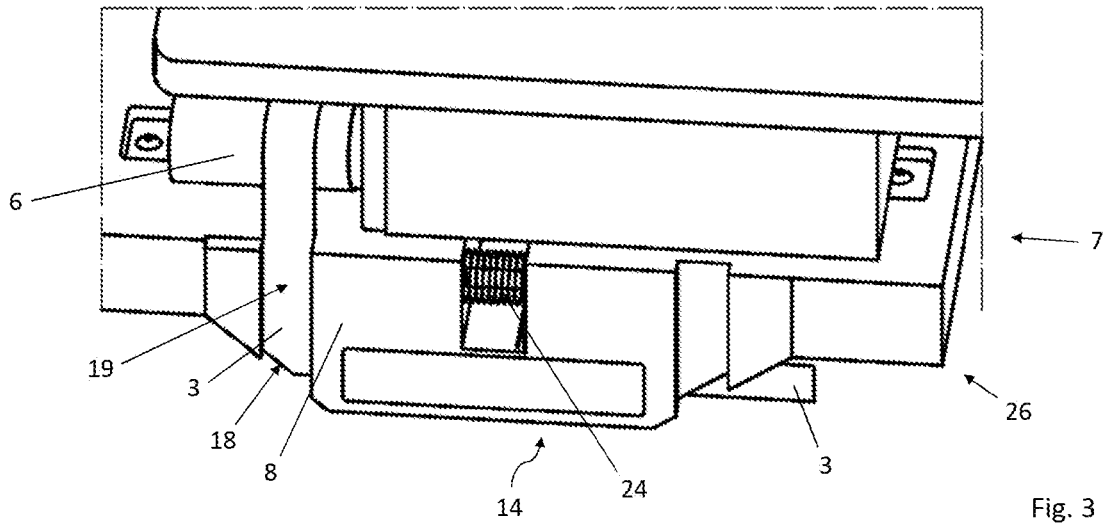
FIG. 3 shows a view from below of the adhesive tape applicator in FIG. 1 and FIG. 2.

FIG. 3 shows the view of the adhesive tape applicator from below. The adhesive tape 3 is here guided around the second deflector roller 6 and into the transverse groove 19 and from there around the oblique deflector edge 18 onto the application side 14 of the deflector edge unit 8.

The deflector edge unit 8 according to the invention is designed so that it can pivot relative to and on the applicator head 7. A recess 22 with two lateral bores 22*a*, 22*b* for a spindle 23 extending along the longitudinal axis L, is introduced into the applicator head 7. The deflector edge unit 8 is arranged so that it can pivot about the longitudinal axis L.

A leg spring 24, which holds the deflector edge unit 8 in a neutral position relative to the applicator head 7, is pushed onto the longitudinal axis L. In the neutral position, the deflector edge unit 8 has an angle $\alpha$ of approximately 20°-90°, preferably 40°-60°, relative to the applicator head 7. The angle $\alpha$ between the application side 14 of the deflector edge unit 8 and a lateral contact side 26 of the applicator head 7 is measured here. Other angles $\alpha$ for the neutral position can of course also be considered. A force therefore needs to be exerted on the deflector edge unit 8 both when the deflector edge unit 8 is folded out and when it is folded in.

In order to apply the adhesive tape 3, the deflector edge unit 8 is folded out by hand using a thumb or a finger into a position approximately at right angles with respect to the applicator head 7. The roll 2 of adhesive tape is here pushed onto the spindle of the holder 1 and the adhesive tape 3 is threaded over the deflector rollers 4, 6, through the transverse groove 19, around the deflector edge 18 and through the longitudinal groove 16.

The deflector edge unit 8 of the adhesive tape applicator is then pushed into an application gap and the adhesive tape applicator is pulled along the application gap from right to left. The application gap is here, for example, the gap between a roof side rail 36 of a motor vehicle and the closed door of the motor vehicle, wherein the door has not yet been provided with an inner lining and seals, such that the gap, a few millimetres wide, is formed between the door and the roof side rail 36. In a cross-section, however, the roof side rail 36 has different angles, for example between the C pillar and B pillar and the B pillar and A pillar of the motor vehicle, to which the adhesive tape applicator according to the invention is, however, adapted automatically when it is drawn along both by the adhesive tape applicator being drawn along with the lateral contact side 26 against the roof side rail 36 and also by the deflector edge unit 8 being drawn along underneath with its application side 14 against the roof side rail 36.

The angle between the application side 14 and the lateral contact side 26, which is usually not a right angle and instead varies, is compensated by the ability of the deflector edge unit 8 to pivot relative to the applicator head 7.

At least one magnet is in each case inlaid in the application side 14 and the lateral contact side 26. An application-side magnet 27 is inlaid into the application side 14, and a first and a second lateral contact-side magnet 28*a*, 28*b* are inlaid into the lateral contact side. The magnets 27, 28*a*, 28*b* draw the application side 14 and the lateral contact side 26 against the steel profile of a roof 32.

Figure 4:
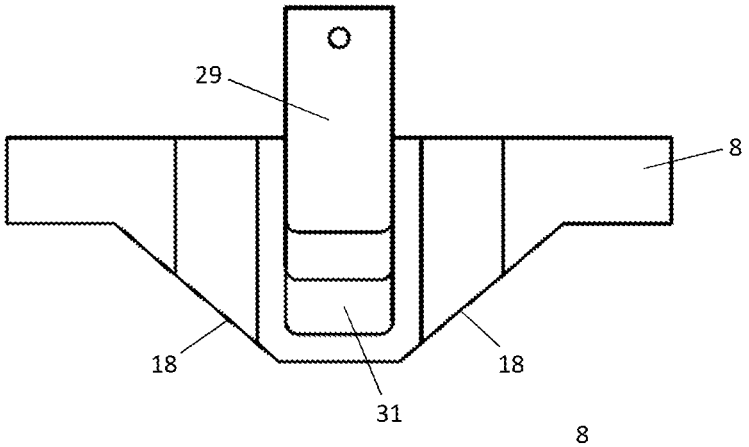
FIG. 4 shows a view from above of a deflector edge unit with a cover.
Figure 5:
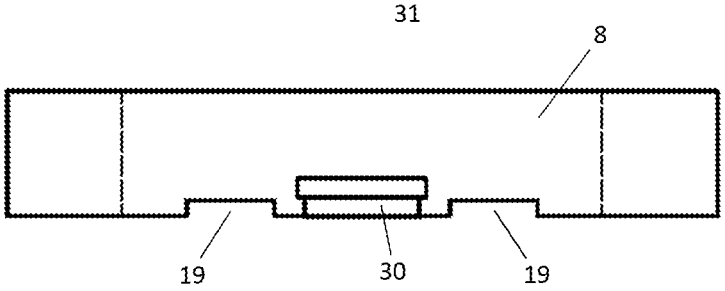
FIG. 5 shows a side view of the deflector edge unit with no cover.

FIG. 4 shows a plan view of the deflector edge unit 8 and FIG. 5 shows the same in a side view. The deflector edge unit 8 has an essentially two-part design. It has the actual deflector edge unit 8 and a displaceable cover 29. A magnet 27 can be clamped, bonded or inlaid inside an interior space 31 of the deflector edge unit 8 and can also be easily removed again therefrom. The magnet 27 inlaid inside the interior space 31 is prevented from falling out by the cover 29 being closed. The cover 29 can be prevented from being opened accidentally by a bore, provided in the cover 29, through which a screw (not shown) passes. The deflector edge unit 8 shown in FIGS. 4 and 5 is mounted in the applicator head 7 so that it can rotate about the spindle 23.

FIG. 5 shows a side view of the deflector edge unit 8 in FIG. 4. A T-shaped groove 30 can be seen here, into which the cover 29 equipped with a corresponding spring can be pushed. FIG. 5 also shows the two transverse grooves 19 along which the adhesive tape is guided and then deflected via the deflector edge 18.

Figure 6:
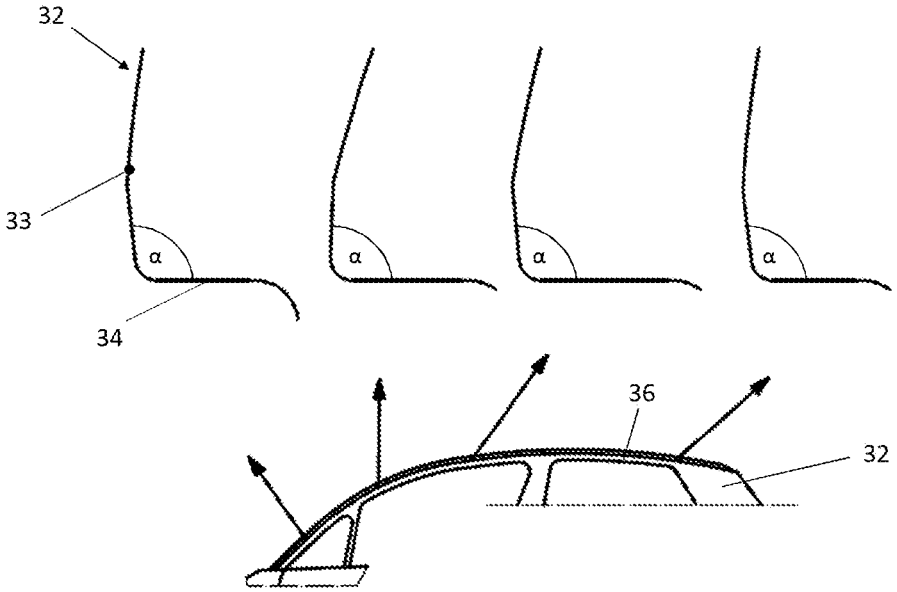
FIG. 6 shows four cross-sections of a roof side rail of a motor vehicle.

FIG. 6 shows in the lower region a side view of a vehicle side and the roof 32 of a motor vehicle. In the upper section of FIG. 6, cross-sections at different points of the roof side rail 32 of a motor vehicle are shown which are marked with an arrow. The first cross-section is arranged before the A pillar, the second and third cross-section are arranged between the A and B pillars, and the third cross-section is arranged in the region of the C pillar of the motor vehicle. It can be seen that an angle $\alpha$ between an inner side 34, which faces the door, and an outer side 33 of the roof side rail 36, which merges into the roof 32, is variable. In the first section before the A pillar, the angle $\alpha$ between the inner side 34 and the outer side 33 is $\alpha>90°$, whilst the angle $\alpha$ varies between the A and B pillars between approximately 85° and 95°, and in the region of the C pillar again assumes approximately $\alpha=95°$. Because the adhesive tape applicator is pressed from outside against the outer side 33 and from below against the inner side 34 of the roof side rail 36, the angle $\alpha$ between the deflector edge unit 8 and the applicator head 7 is adapted to this angle between the outer side 33 and the inner side 34 automatically when the adhesive tape applicator is guided along the roof side rail 36.

LIST OF REFERENCE SYMBOLS

1 holder
2 roll of adhesive tape
3 adhesive tape
4 deflector roller
6 deflector roller
7 applicator head
8 deflector edge unit
9 base unit
11 block
12 handle
13 plate
14 application side
16 longitudinal groove
17 pressure adhesive tape
18 deflector edge
19 transverse groove

22 recess
22*a* bore
22*b* bore
23 spindle
24 leg spring
26 lateral contact side
27 magnet
28*a* magnet
28*b* magnet
29 cover
30 T-shaped groove
31 inner space
32 roof
33 outer side
34 inner side
36 roof side rail
A direction of application
B width
L longitudinal axis
α angle

What is claimed is:

1. An adhesive tape applicator comprising:

a holder configured to hold a roll of adhesive tape, a handle, an applicator head in a fixed position relative to the handle; wherein the application head comprises a deflector edge unit that is moveable relative to the applicator head, and wherein the adhesive tape is applied in an application direction; wherein the applicator head comprises a transverse groove, extending transversely to the application direction of the adhesive tape; wherein the applicator head further comprises a longitudinal groove arranged in the application direction on an application side of the deflector edge unit.

2. The adhesive tape applicator of claim 1, wherein the deflector edge unit is rotatable about an axis relative to the applicator head by an angle (α); and further wherein the deflector edge unit is coupled to the applicator head with a spring.

3. The adhesive tape applicator of claim 1, wherein a pressure adhesive tape is inserted in the longitudinal groove.

4. The adhesive tape applicator of claim 1, wherein the holder comprises a spindle oriented in the application direction, onto which the roll of adhesive tape is pushed; wherein the adhesive tape application further comprises two deflector rollers; and wherein the adhesive tape is supplied to the applicator head around the two deflector rollers.

5. The adhesive tape applicator of claim 1, wherein the applicator head has an application side and a lateral contact side; wherein the lateral contact side comprises a first magnet; wherein the application side comprises a second magnet; wherein the first and second magnets maintain the contact side and the application side each in contact with a metal profile during use of the adhesive tape applicator.

6. The adhesive tape applicator of claim 1, further comprising a base unit; wherein the base unit comprises the holder and the handle, wherein the applicator head is arranged replaceably on the base unit.

7. The adhesive tape applicator of claim 1, wherein the deflector edge unit has a first deflector edge and a second deflector edge; wherein the second deflector edge is arranged as a mirror image of the first deflector edge.

8. The adhesive tape applicator of claim 1, wherein the deflector edge unit has an inner space configured to be opened and closed by a cover; wherein a magnet is disposed in the inner space.

* * * * *